US006836900B1

(12) United States Patent
Fus, Sr.

(10) Patent No.: US 6,836,900 B1
(45) Date of Patent: Jan. 4, 2005

(54) BIB

(76) Inventor: James F. Fus, Sr., 602 West State St., Mt. Pleasant, IA (US) 52641

( * ) Notice: Subject to any disclaimer, the term of this patent is extended or adjusted under 35 U.S.C. 154(b) by 0 days.

(21) Appl. No.: 10/836,350

(22) Filed: May 3, 2004

(51) Int. Cl.[7] ..... A41B 13/10
(52) U.S. Cl. ..... 2/52; 2/49.1
(58) Field of Search ..... 2/49.1, 49.2, 49.3, 2/49.4, 49.5, 48, 52, 51, 50, 468, 46, 47, 129, 132, 134, 136–140, 155, 156; 24/7, 9, 3.4

(56) References Cited

U.S. PATENT DOCUMENTS

| | | | | | |
|---|---|---|---|---|---|
| 115,238 | A | | 5/1871 | Raiford | |
| 361,537 | A | * | 4/1887 | Morrison | 2/52 |
| 796,695 | A | * | 8/1905 | Blake | 2/52 |
| 902,568 | A | * | 11/1908 | Dufresne | 24/9 |
| 996,084 | A | | 6/1911 | Herring | |
| 1,628,433 | A | * | 5/1927 | Schilke | 2/52 |
| 2,154,464 | A | | 4/1939 | Lozier | |
| 2,421,195 | A | * | 5/1947 | Goldsmith | 2/48 |
| 2,430,941 | A | * | 11/1947 | Long | 2/49.1 |
| 2,525,115 | A | * | 10/1950 | Britton | 2/49.2 |
| 2,690,563 | A | * | 10/1954 | Wilson | 2/49.1 |
| 2,778,024 | A | | 1/1957 | Randolph | |
| 2,884,638 | A | * | 5/1959 | Ream | 2/48 |
| 2,948,035 | A | | 8/1960 | McCarthy | |
| 3,042,930 | A | * | 7/1962 | Martinez | 2/48 |
| 3,597,763 | A | | 8/1971 | Bienvenu | |
| 3,798,674 | A | | 3/1974 | Daniel | |
| 3,857,116 | A | | 12/1974 | Meeker | |
| 4,660,224 | A | | 4/1987 | Ashcraft | |
| 5,621,916 | A | | 4/1997 | Bell | |
| 5,956,763 | A | | 9/1999 | Blackshear | |
| 6,182,290 | B1 | | 2/2001 | Morris | |
| 6,317,890 | B1 | | 11/2001 | Kuhn | |
| 6,427,240 | B1 | | 8/2002 | Royal | |
| 6,532,596 | B1 | | 3/2003 | Fosmo | |
| 6,718,554 | B1 | * | 4/2004 | Langston | 2/49.1 |

FOREIGN PATENT DOCUMENTS

| | | | | |
|---|---|---|---|---|
| CA | 1053402 | | 10/1975 | |
| CH | 686 550 A5 | | 4/1996 | |
| FR | 1126168 | * | 7/1956 | 2/52 |
| GB | 10992 | * | 5/1903 | 2/52 |
| GB | 8300 | * | 4/1905 | 2/52 |
| GB | 27144 | * | 11/1913 | 2/52 |
| GB | 2 364 885 A | | 2/2002 | |
| GB | 2 390 531 A | | 1/2004 | |
| WO | WO 2004/006697 A1 | | 1/2004 | |

* cited by examiner

*Primary Examiner*—Amy B. Vanatta
(74) *Attorney, Agent, or Firm*—Richard C. Litman

(57) ABSTRACT

The bib of the present invention has a collar and a chest-covering fabric extending from and attached to the collar. The collar is a resilient, generally C-shaped, flat plastic ring that is disposed within a sleeve. The fabric is attached to the lower end of the sleeve and it covers a user's chest to protect the user's clothes from food stains and spills. Consequently, the bib covers the user's chest while being retained about the neck by the resilient collar, eliminating the need for reaching behind the neck to fasten and unfasten the bib. The bib is suitable for user's of any age, and is particularly well adapted for use by the elderly, the disabled, and small toddlers. The chest cover may have any desired shape or color, and may have indicia thereon.

7 Claims, 4 Drawing Sheets

BIB

BACKGROUND OF THE INVENTION

1. Field of the Invention

The present invention relates to bibs, more particularly to bibs that can be easily slipped around a neck without requiring a fastening or securing means.

2. Description of the Related Art

Bibs are used by people of different ages at home, in a restaurant or in a nursing home. Regardless of who uses it and where it is used, bibs help to prevent clothes from being soiled. Bibs have been made in a variety of sizes to cover a user anywhere between the user's chest to the user's lap. Many bibs are reusable, being made from cloth or plastic, while others are disposable, being made from inexpensive materials such as a plastic coated paper or thin plastic. Regardless of the bib's size and the material used to make the bib, most bibs utilize a securing means for retaining the bib on the user's neck. Normally the securing means, e.g., ties, snaps, etc., is disposed behind the user's neck and therefore requires the user to reach behind their neck to secure the bib. Though this is not a problem for most people, young children and elderly individuals who still maintain some degree of independence may find it difficult to reach behind their necks to secure the bib. Thus, a bib is desired that can be easily slipped on one's neck and retained on the neck without requiring a securing means.

U.S. Pat. No. 115,238, issued to Raiford on May 23, 1871, shows a device for attaching a napkin to a person. The device has a slitted metallic band that has bulb-like ends disposed near the slit. The band is capable of being distended to fit around a person's neck. The band can be slipped through a hem of a napkin to retain the napkin and ultimately allow the napkin to hang from the person's neck.

U.S. Pat. No. 2,154,464, issued to Lozier on Apr. 18, 1939, describes a garment support comprising a flat, spring steel body-encircling member and an apron. The steel member is slipped through a hem on the apron and retained in place by clips disposed on the steel member. U.S. Pat. No. 2,948,035, issued to McCarthy on Aug. 9, 1960, discloses a bib holder. The holder is a tubular neck ring having a slit in the middle portion of the ring for receiving and holding a corner of a napkin or the bib.

U.S. Pat. No. 5,621,916, issued to Bell on Apr. 22, 1997, describes a bib for use while operating a vehicle. The bib comprises a sheet of material having two hemmed ends. One hemmed end receives a neck ring and the second hemmed end receives a steering column ring. Both rings are split rings that have retaining balls disposed on the ends of the ring to prevent the sheet of material from slipping off the rings.

British Patent Number 2,390,531, published on Jan. 14, 2004, and International Patent Number WO 2004/006697, published on Jan. 22, 2004, both describe a flexible, absorbent neck bib made of a cylindrical absorbent material. The flexible, absorbent neck bib is encased within an outer sheath made of permeable or semi-permeable material. The absorbent material has securing means, such as ties, Velcro®, snaps, hook and eye fasteners, etc., that serve to retain the shape of the bib and fasten the bib around a person's neck. The bib is meant to hang around the neck, but does not extend downward to cover the chest area or clothing.

Many bibs have been disclosed that have a fastening means disposed at the back of a user's neck. U.S. Pat. No. 4,660,224, issued to Ashcraft on Apr. 28, 1987, discloses a unisex plastic-coated paper bib-apron, which drapes from the user's neck onto the user's legs. An adhesive pad or other securing material is disposed on neck panels of the bib-apron, requiring the user to secure the neck panels together from behind the user's head.

U.S. Pat. No. 6,182,290, issued to Morris on Feb. 6, 2001, describes an inexpensive disposable covering that uses adhesive material on one of two neck panels to hold the covering around a user's neck. Swiss Patent Number 686,550, published on Apr. 30, 1996, describes a napkin that can be converted into a bib by detaching a neck section on the napkin and securing a glued joint around a person's neck.

British Patent Number 2,364,885, published on Feb. 13, 2002, discloses a neck fastener for a bib or other garment. The bib or garment has a roll collar defining a channel through which a tape is passed and ultimately a bow is tied around the user's neck. Canadian Patent Number 1,053,402 published on May 1, 1979, discloses a protective neck and chest protector comprising a neckband and a bib, both of which are made of a resilient cushion or pad. The neckband has a securing means that can be hook and loop type material that can be secured from behind a user's neck.

U.S Pat. No. 3,597,763, issued to Bienvenu on Aug. 10, 1971, discloses a rigid bib for infants. The bib is made of plastic-coated cardboard or similar material and maintains a trough-like shape when worn. The bib may be attached around a neck by either retaining tabs or a tie that is disposed behind the user's neck.

Other bibs designed to drape over the user's body have been disclosed in U.S. Pat. No. 2,778,024, issued to Randolph on Jan. 22, 1957 (neck protector); U.S. Pat. No. 3,798,674, issued to Daniel on Mar. 26, 1974 (a drape having a collar and a bib where the collar and bib are made from the same material); U.S. Pat. No. 6,532,596, issued to Fosmo on Mar. 19, 2003 (bib-like cover having a stretchable and-deformable collar); and U.S. Pat. No. 5,956,763, issued to Blackshear on Sep. 28, 1999 (disposable bib that uses has a wire-reinforced tab to secure the bib to a shirt's neck collar.)

Still other bibs or clothing protectors are disclosed in U.S. Pat. No. 3,857,116, issued to Meeker on Dec. 31, 1974 (method of making a towel bib); U.S. Pat. No. 6,317,890, issued to Kuhn on Nov. 20, 2001 (protective garment overlay apparatus comprising a napkin and a rigid gripping component that can be deformed to secure the napkin to an anchoring element); U.S. Pat. No. 996,084, issued to Herring on Jun. 27, 1911; and U.S. Pat. No. 6,427,240, issued to Royal on Aug. 6, 2002.

None of the above inventions and patents, taken either singly or in combination, is seen to describe the instant invention as claimed. Thus, a bib solving the aforementioned problems is desired.

SUMMARY OF THE INVENTION

The bib of the present invention has a collar and a chest-covering fabric extending from and attached to the collar. The collar is a resilient, generally C-shaped, flat plastic ring that is disposed within a sleeve. The fabric is attached to the lower end of the sleeve and covers a user's chest to protect the user's clothes from food stains and spills. Consequently, the bib covers the user's chest while being retained about the neck by the resilient collar, eliminating the need for reaching behind the neck to fasten and unfasten the bib. The bib is suitable for user's of any age, and is particularly well adapted for use by the elderly, the disabled, and small toddlers. The chest cover may have any desired shape or color, and may have indicia thereon.

These and other features of the present invention will become readily apparent upon consideration of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
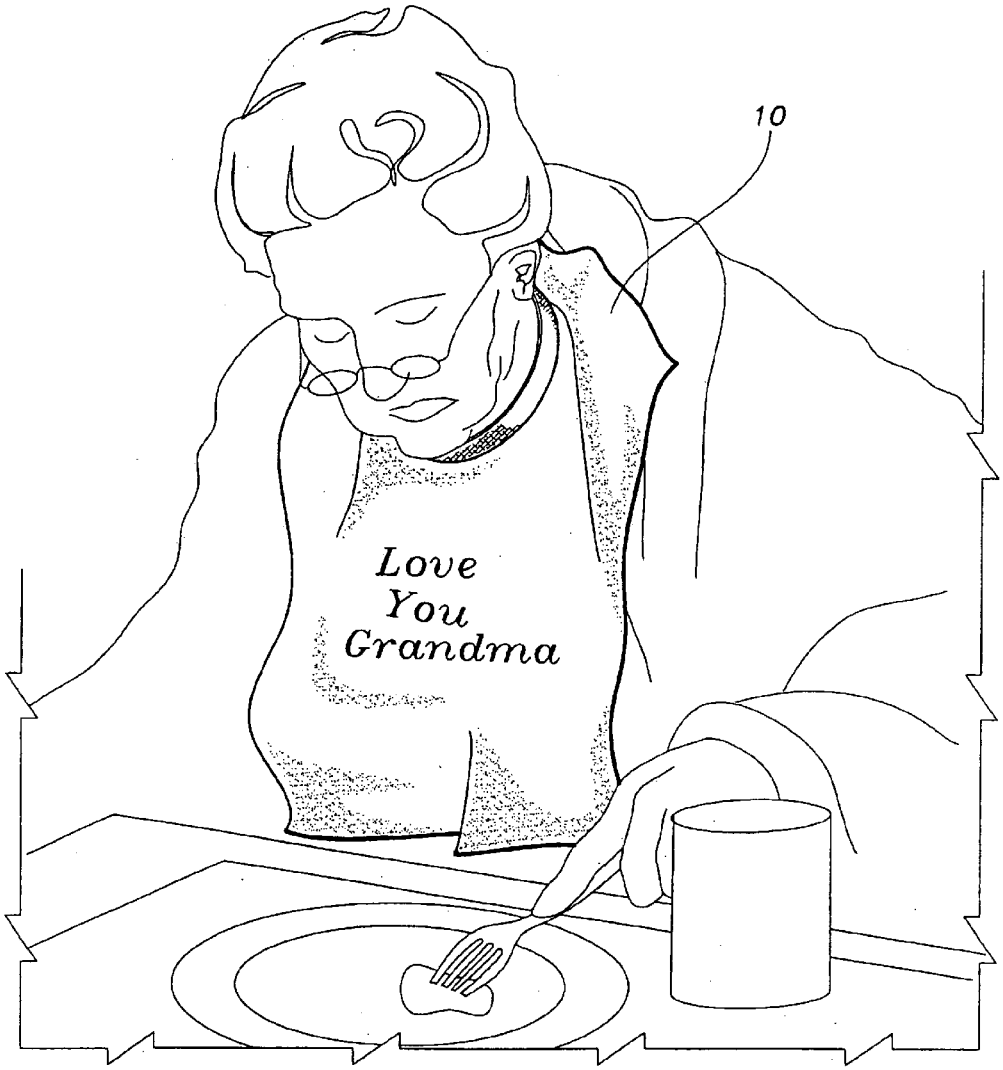
FIG. 1 is an environmental, perspective view of a bib according to the present invention.
Figure 2:
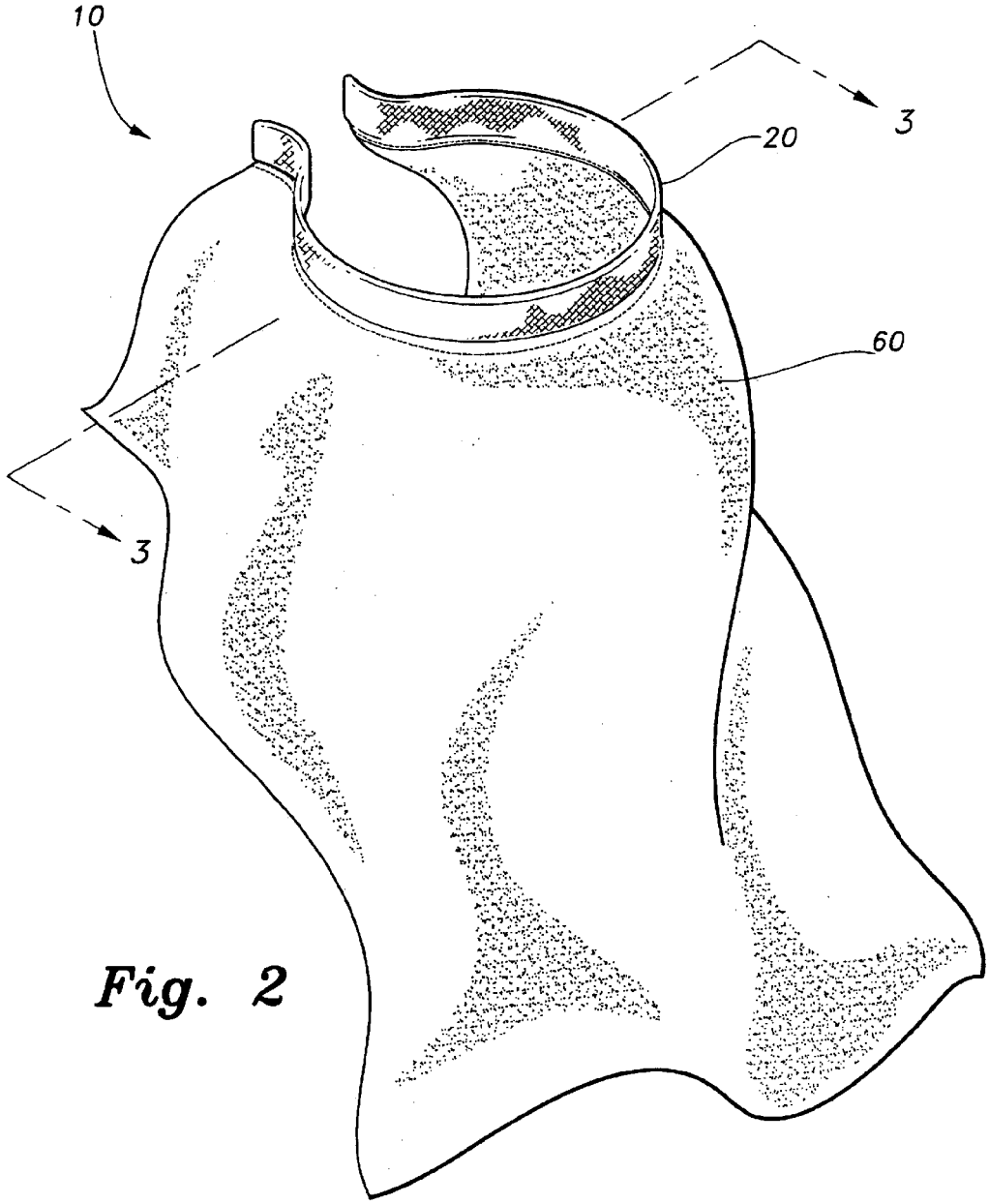
FIG. 2 is a perspective view of the bib according to the present invention.

The present invention is a bib, designated generally as 10 in the drawings. As shown in FIGS. 1 and 2, the bib 10 is worn around a user's neck and hangs over the user's upper torso, covering the chest area. The bib 10 has a collar 20 and a fabric chest cover 60 attached to and extending from the collar 20.

Figure 3:
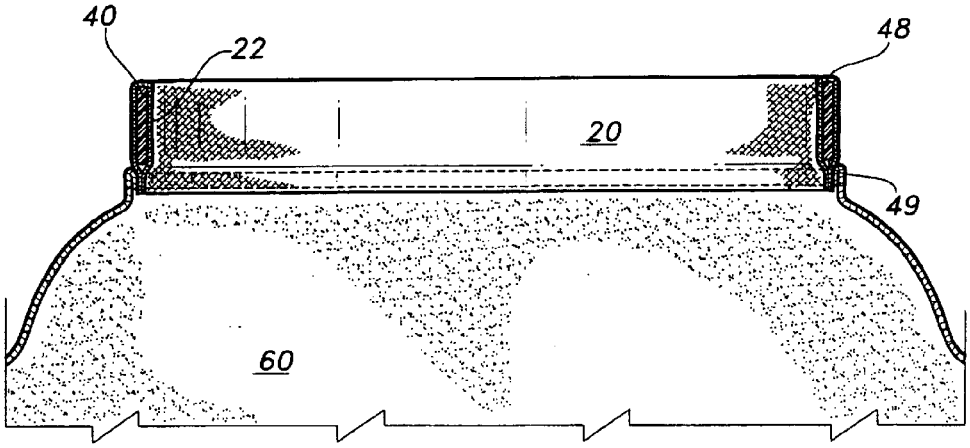
FIG. 3 is a section view drawn along lines 3—3 of FIG. 2.

As shown in FIG. 3, the collar 20 comprises a sleeve 22 and a ring 40. The sleeve 22 fully encompasses and retains the ring 40. The sleeve 22 is preferably made of stretchable, ribbed material, or other similar elastic material, and conforms to the shape of the ring 40 disposed within. Though the sleeve 20 is designed to fully encase the ring 40, an alternative sleeve embodiment may have an opening with a cover attached thereto by a releasable fastener to receive and remove the ring 40 from the sleeve 22.

Figure 4:
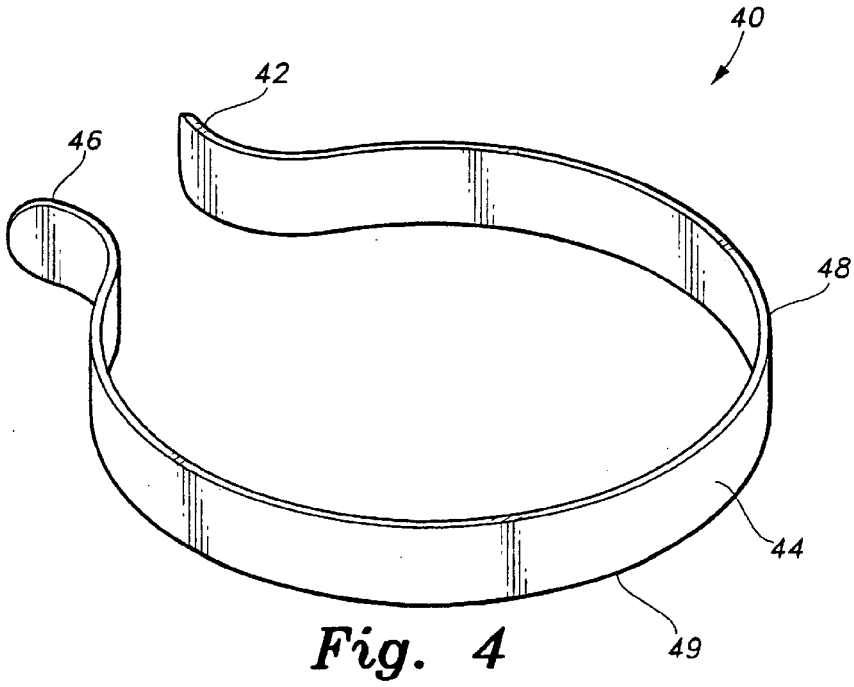
FIG. 4 is a perspective view of a ring forming the collar of the bib of the present invention.

Viewing FIG. 3 in conjunction with FIG. 4, the ring 40 is flat having a top edge 48 and a bottom edge 49 and has a generally C-shaped body 44 with two opposing tabbed ends 42, 46. The tabbed ends 42, 46 extend from the body 44 and curve outward. This ring 40 is preferably thin and flat, having a rectangular cross section. The ring 40, however, may take alternative cross-sectional shapes and may be thicker, if desired.

Figure 3A:
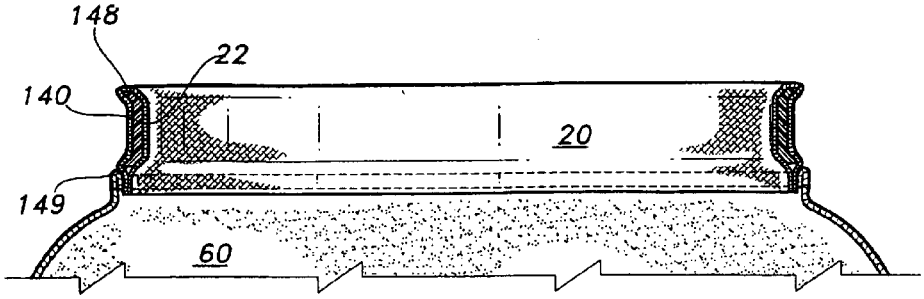
FIG. 3A is a section view similar to FIG. 3 showing a ring having an alternate cross-sectional shape.
Figure 3B:
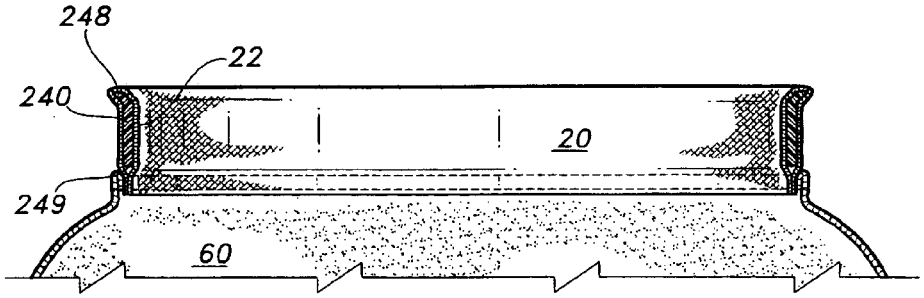
FIG. 3B is a section view similar to FIG. 3 showing a ring having a second alternate cross-sectional shape.
Figure 3C:
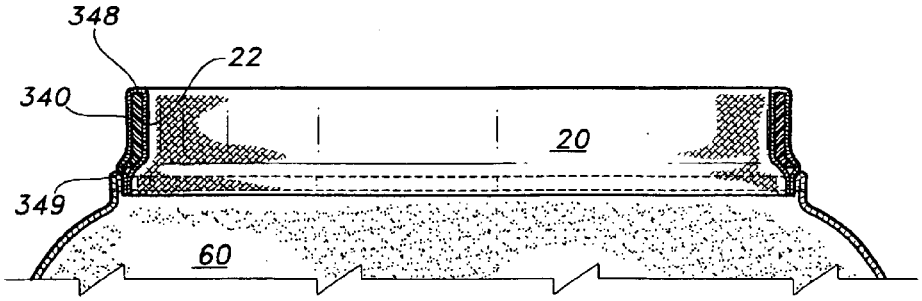
FIG. 3C is a section view similar to FIG. 3 showing a ring having a third alternate cross-sectional shape.

For example, as shown in FIG. 3A, ring 140 has both a top edge 148 and a bottom edge 149 curved or angled outward. Alternatively, FIG. 3B shows a ring 240 in which only the top edge 248 is curved or angled outwardly. In still another variation, shown in FIG. 3C, bottom edge 349 of ring 340 may be curved or angled outwardly. In the embodiments of FIGS. 3A–3C, the central section of the ring between the top and bottom edges is offset or projected inwardly due to the curvature or outward angling of the top and/or bottom edge(s) of the ring. In these alternative embodiments, the curved or angled top edge and/or bottom edge mostly likely would not extend into the tabs 42, 46, but could extend into the tabs 42, 46, if desired.

The ring 40 may be made from plastic by injection molding or by any other plastic forming process known in the art, from metal, or from any other flexible, resilient material. The material used to make the ring 40 has sufficient thermal resistance to withstand heat generated from a dryer, since the bib 10 is intended to be reusable and washable.

The ring 40 may be manufactured in a variety of sizes to fit around any size neck, from a toddler or small child neck to an adult's neck. Illustrative rings sizes range from 11" to 18", but other sizes and half sizes are also possible.

The fabric chest cover 60 can be any shape and length sufficient to cover at least a portion of the chest and can be made of any material. Ideally the fabric 60 is made of an absorbent material, such as cotton terry cloth. The terry cloth material may be reinforced with a non-absorbent material on one side. The fabric 60 should not be limited to terry cloth material and can be made of other types of material. To give the bib 10 a finished look, binding may be sewn to the edges of the fabric 60. Also, as shown in FIG. 1, lettering or other indicia may be displayed on the facade of the bib 10, if desired.

The chest cover 60 is permanently attached to the lower end of the collar 20 by stitches and is designed to extend over the upper torso of the user's body. The chest cover 60 has one generally C-shaped edge, which is dimensioned and configured to the size and shape of the ring 40 disposed within the sleeve 22 of the collar 20. In use, a user will push the collar 20 against the neck, forcing the tabbed ends 42, 46 of the resilient ring 40 to spread apart and glide around the neck. Alternatively, the user may pull apart the tabbed ends 42, 46 and place the collar 20 on the neck. Once the ring 40 is around the neck, the ring 40 will immediately return back to its original C-shape to keep the bib 10 around the neck.

It is to be understood that the present invention is not limited to the embodiment described above, but encompasses any and all embodiments within the scope of the following claims.

I claim:

1. A bib, comprising:

a collar having a resilient ring and a flexible sleeve disposed about the ring;

said ring being substantially C-shaped, having a first end, a second end, a top edge, a bottom edge, and a central portion, the ring being dimensioned and configured for attachment around a neck of a wearer;

wherein said central portion defines an inner surface and an outer surface, said top edge and said bottom edge extend outwardly from said central portion, and the outer surface of the central portion is offset inwardly from the top edge and the bottom edge;

whereby, when in use, the inner surface of the central portion is disposed adjacent the neck of the wearer; said top edge and said bottom edge extend, opposite said inner surface, away from the neck of the wearer; and a fabric chest cover having one C-shaped edge attached to the sleeve, the chest cover extending from the sleeve and being adapted to cover at least a portion of the wearer's chest.

2. The bib according to claim 1, wherein the ends of said ring have curved tabs extending outwardly therefrom.

3. The bib according to claim 1, wherein said ring has a substantially thin, generally rectangular cross section.

4. The bib according to claim 1, wherein said ring is thin.

5. The bib according to claim 1, wherein said ring is formed by injection molding.

6. The bib according to claim 1, wherein said ring is made from plastic.

7. The bib according to claim 1, wherein said chest cover is sewn to the sleeve.

* * * * *